US007556097B2

(12) United States Patent
Heller et al.

(10) Patent No.: US 7,556,097 B2
(45) Date of Patent: Jul. 7, 2009

(54) DOCKING RECEIVER OF A ZONE ISOLATION ASSEMBLY FOR A SUBSURFACE WELL

(75) Inventors: Noah R. Heller, Corte Madera, CA (US); Peter F. Moritzburke, Corte Madera, CA (US)

(73) Assignee: BESST, Inc., San Rafael, CA (US)

( * ) Notice: Subject to any disclaimer, the term of this patent is extended or adjusted under 35 U.S.C. 154(b) by 281 days.

(21) Appl. No.: 11/651,875

(22) Filed: Jan. 9, 2007

(65) Prior Publication Data

US 2007/0158066 A1 Jul. 12, 2007

Related U.S. Application Data

(60) Provisional application No. 60/758,030, filed on Jan. 11, 2006, provisional application No. 60/765,249, filed on Feb. 3, 2006.

(51) Int. Cl.
*E21B 49/08* (2006.01)

(52) U.S. Cl. ..... 166/264; 166/69; 166/162

(58) Field of Classification Search ..... 166/264, 166/162, 69; 73/152.23
See application file for complete search history.

(56) References Cited

U.S. PATENT DOCUMENTS 2,128,253 A 8/1938 Johnson
2,137,296 A 11/1938 Macready
2,190,250 A * 2/1940 Blackburn ..... 166/185
2,227,539 A 1/1941 Dorton
2,946,387 A 7/1960 Hooker
3,022,828 A 2/1962 Hodges
3,152,296 A 10/1964 Pearcy
2,776,013 A 1/1975 Tausch
3,969,937 A 7/1976 Barrington et al.

(Continued)

OTHER PUBLICATIONS

U.S. Appl. No. 11/178,055, filed Jul. 8, 2005, entitled "Systems and Methods for Installation, Design and Operation of Grooundwater Monitoring Systems in Boreholes".

(Continued)

*Primary Examiner*—Giovanna C Wright
(74) *Attorney, Agent, or Firm*—Roeder & Broder LLP; James P. Broder

(57) ABSTRACT

A docking receiver (48) for a subsurface well (12) having a fluid inlet structure (29), a riser pipe (30) and a docking apparatus (50) includes an upper section (372A) and a lower section (374A). The upper section (372A) is secured to the riser pipe (30). The lower section (374A) is secured to the fluid inlet structure (29). The lower section (374A) receives the docking apparatus (50) into an engaged position wherein fluid communication between a first zone (26) and a second zone (28) of the well (12) is inhibited. The lower section (374A) includes a contact surface (376A) and a distal region (377A). The contact surface (376A) contacts the docking apparatus (50) when the docking apparatus (50) is in the engaged position. The distal region (377A) is positioned more distally from a surface region (32) of the well (12) than the contact surface. The lower section (374A) can have a lower inner diameter (380UD, 380LD) that varies within the distal region (377A). When the docking apparatus (50) is not in the engaged position with the docking receiver (48), the first zone (26) is in fluid communication with the second zone (28).

32 Claims, 10 Drawing Sheets

U.S. PATENT DOCUMENTS

| | | | |
|---|---|---|---|
| 4,475,595 | A | 10/1984 | Watkins et al. |
| 4,489,779 | A | 12/1984 | Dickinson |
| 4,701,107 | A | 10/1987 | Dickinson |
| 4,942,923 | A | 7/1990 | Geeting |
| 4,995,456 | A | 2/1991 | Cornette et al. |
| 5,293,931 | A | 3/1994 | Nichols et al. |
| 5,293,934 | A | 3/1994 | Burge et al. |
| 5,450,900 | A | 9/1995 | Schalla et al. |
| 5,473,939 | A | 12/1995 | Leder et al. |
| 5,687,791 | A | 11/1997 | Beck et al. |
| 5,708,220 | A | 1/1998 | Burge |
| 5,829,520 | A | 11/1998 | Johnson |
| 5,909,773 | A | 6/1999 | Koehler et al. |
| 6,158,516 | A | 12/2000 | Smith et al. |
| 6,301,959 | B1 | 10/2001 | Hrametz et al. |
| 6,508,310 | B1 | 1/2003 | Mioduszewski et al. |
| 6,619,931 | B2 | 9/2003 | Anderson |
| 6,668,943 | B1 | 12/2003 | Maus et al. |
| 6,722,432 | B2 | 4/2004 | Spiers et al. |
| 6,745,835 | B2 | 6/2004 | Fields |
| 6,935,356 | B2 | 8/2005 | Shepard et al. |
| 7,004,252 | B2 | 2/2006 | Vise, Jr. |
| 7,111,682 | B2 | 9/2006 | Blaisdell |
| 7,320,364 | B2 | 1/2008 | Fairbanks |
| 7,461,547 | B2 | 12/2008 | Terabayashi et al. |
| 2002/0053438 | A1 | 5/2002 | Williamson, Jr. |
| 2002/0166663 | A1 | 11/2002 | Last et al. |
| 2003/0127227 | A1 | 7/2003 | Fehr et al. |
| 2004/0050548 | A1 | 3/2004 | Dybdahl |
| 2004/0134663 | A1 | 7/2004 | Khomynets |
| 2005/0028974 | A1 | 2/2005 | Moody |
| 2005/0051329 | A1 | 3/2005 | Blaisdell |
| 2005/0224229 | A1 | 10/2005 | Blacklaw |
| 2007/0199691 | A1 | 8/2007 | Heller et al. |

OTHER PUBLICATIONS

San Diego Plastics, Inc., http://www.sdplastics.com/pvc.html, Jan. 21, 1997. Web page is unavailable.

International Search Report, PCT/US07/00703 (relevant page).

* cited by examiner

DOCKING RECEIVER OF A ZONE ISOLATION ASSEMBLY FOR A SUBSURFACE WELL

RELATED APPLICATIONS

This Application claims the benefit on U.S. Provisional Application Ser. No. 60/758,030 filed on Jan. 11, 2006, and on U.S. Provisional Application Ser. No. 60/765,249 filed on Feb. 3, 2006. The contents of U.S. Provisional Application Ser. Nos. 60/758,030 and 60/765,249 are incorporated herein by reference.

BACKGROUND

Subsurface wells for extracting and/or testing fluid (liquid or gas) samples on land and at sea have been used for many years. Many structures have been developed in an attempt to isolate the fluid from a particular depth in a well so that more accurate testing of the fluid at that depth "below ground surface" (bgs) can be performed. Unfortunately, attempts to accurately and cost-effectively accomplish this objective have been not altogether satisfactory.

For example, typical wells include riser pipes have relatively large diameters, i.e. 2-4 inches, or greater. Many such wells can have depths that extend hundreds or even thousands of feet bgs. In order to accurately remove a fluid sample from a particular target zone within a well, such as a sample at 1,000 feet bgs, typical wells require that the fluid above the target zone be removed at least once in order to obtain a more representative fluid sample from the desired level. From a volumetric standpoint, traditional wet casing volumes of 2-inch and 4-inch monitoring wells are 0.63 liters (630 ml) to 2.5 liters (2,500 ml) per foot, respectively. As an example, to obtain a sample at 1,000 feet bgs, approximately 630 liters to 2,500 liters of fluid must be purged from the well. The time required and costs associated with extracting this fluid from the well can be rather significant.

One method of purging fluid from the well and/or obtaining a fluid sample includes using coaxial gas displacement within the riser pipe of the well. Unfortunately, this method can have several drawbacks. First, gas consumption during pressurization of these types of systems can be relatively substantial because of the relatively large diameter and length of riser pipe that must be pressurized. Second, introducing large volumes of gas into the riser pipe can have adverse effects on the volatile organic compounds (VOC's) being measured in the fluid that is collected. Third, a pressure sensor that may be present within the riser pipe of a typical well is subjected to repeated significant pressure changes from the pressurization of the riser pipe. Over time, this artificially-created range of pressures in the riser pipe can have a negative impact on the accuracy of the pressure measurements from the sensor. Fourth, residual gas pressure can potentially damage one or more sensors and/or alter readings from the sensors once substantially all of the fluid has passed through the sample collection line past the sensors. Fifth, any leaks in the system can cause gas to be forcibly infused into the ground formation, which can influence the results of future sample collections. Moreover, no ASTM standard currently exists for pressurizing plastic riser pipe during the pumping process. Lack of proper standards in this regard can result in uncertainties regarding safe levels of riser pipe pressurization.

Another method for purging fluid from these types of wells includes the use of a bladder pump. Bladder pumps include a bladder that alternatingly fills and empties with a gas to force movement of the fluid within a pump system. However, bladder pumps can be susceptible to leakage due to becoming fatigued or detached during pressurization. Further, the initial cost as well as maintenance and repair of bladder pumps can be relatively expensive. In addition, at certain depths, bladder pumps require an equilibration period during pressurization to decrease the likelihood of damage to or failure of the pump system. This equilibration period can result in a slower overall purging process, which decreases efficiency.

An additional method for purging fluid from a well includes using an electric submersible pump system having an electric motor. This type of system can be susceptible to electrical shorts and/or burning out of the electric motor. Additionally, this type of pump typically uses one or more impellers that can cause pressure differentials (e.g., drops), which can result in VOC loss from the sample being collected. Operation of these types of electric pumps can also raise the temperature of the groundwater, which can also impact VOC loss. Moreover, these pumps can be relatively costly and somewhat more difficult to repair and maintain.

Further, the means for physically isolating a particular zone of the well from the rest of the well can have several shortcomings. For instance, inflatable packers are commonly used to isolate the fluid from a particular zone either above or below the packer. However, these types of packers can be subject to leakage, and can be cumbersome and relatively expensive. In addition, these packers are susceptible to rupturing, which can contaminate the desired fluid sample and result in further significant cost expenditures.

SUMMARY

The present invention is directed toward a docking receiver for a subsurface well. The subsurface well extends downward from a surface region, and includes a fluid inlet structure, a riser pipe and a docking apparatus. The fluid inlet structure receives a first fluid and at least partially defines a first zone. The riser pipe at least partially defines a spaced-apart second zone that is positioned more proximally to the surface region than the first zone. The docking apparatus is selectively moved from the surface region toward the fluid inlet structure.

The docking receiver includes an upper section and a lower section. The upper section is secured to the riser pipe. In certain embodiments, the upper section has an upper inner diameter that is substantially constant. The lower section can be secured to the fluid inlet structure. The lower section receives the docking apparatus into an engaged position that inhibits fluid communication between the first zone and the second zone. Additionally, the lower section includes a contact surface and a distal region. The contact surface contacts the docking apparatus when the docking apparatus is in the engaged position. In some embodiments, the contact surface is tapered. The distal region is positioned more distally from the surface region than the contact surface. In various embodiments, the lower section has a lower inner diameter that varies within the distal region.

In one embodiment, the lower inner diameter of the distal region can decrease in a direction from the contact surface toward the fluid inlet structure. In an alternative embodiment, the lower inner diameter of the distal region can increase in a direction from the contact surface toward the fluid inlet structure.

In one embodiment, the lower section has roughly an hourglass configuration. The lower section can include threads that threadedly engage the fluid inlet structure. The lower section can at least partially define the first zone. The upper section can include threads that threadedly engage the riser pipe. The upper-section can at least partially define the second zone.

In certain embodiments, when the docking apparatus is not in the engaged position with the docking receiver, the first zone is in fluid communication with the second zone. Further, the subsurface well can include a pump assembly that is coupled to the docking apparatus. In some embodiments, the docking receiver receives the pump assembly into the first zone when the docking apparatus is in the engaged position with the docking receiver. Additionally or alternatively, the subsurface well can include a fluid collector that is coupled to the docking apparatus. In some embodiments, the docking receiver can receive the fluid collector into the first zone when the docking apparatus is in the engaged position with the docking receiver. In various embodiments, in the engaged position, the docking receiver is adapted to maintain a seal with the docking apparatus substantially by the force of gravity imparted upon the docking apparatus against the docking receiver.

The present invention is also directed toward a method for installing the subsurface well.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
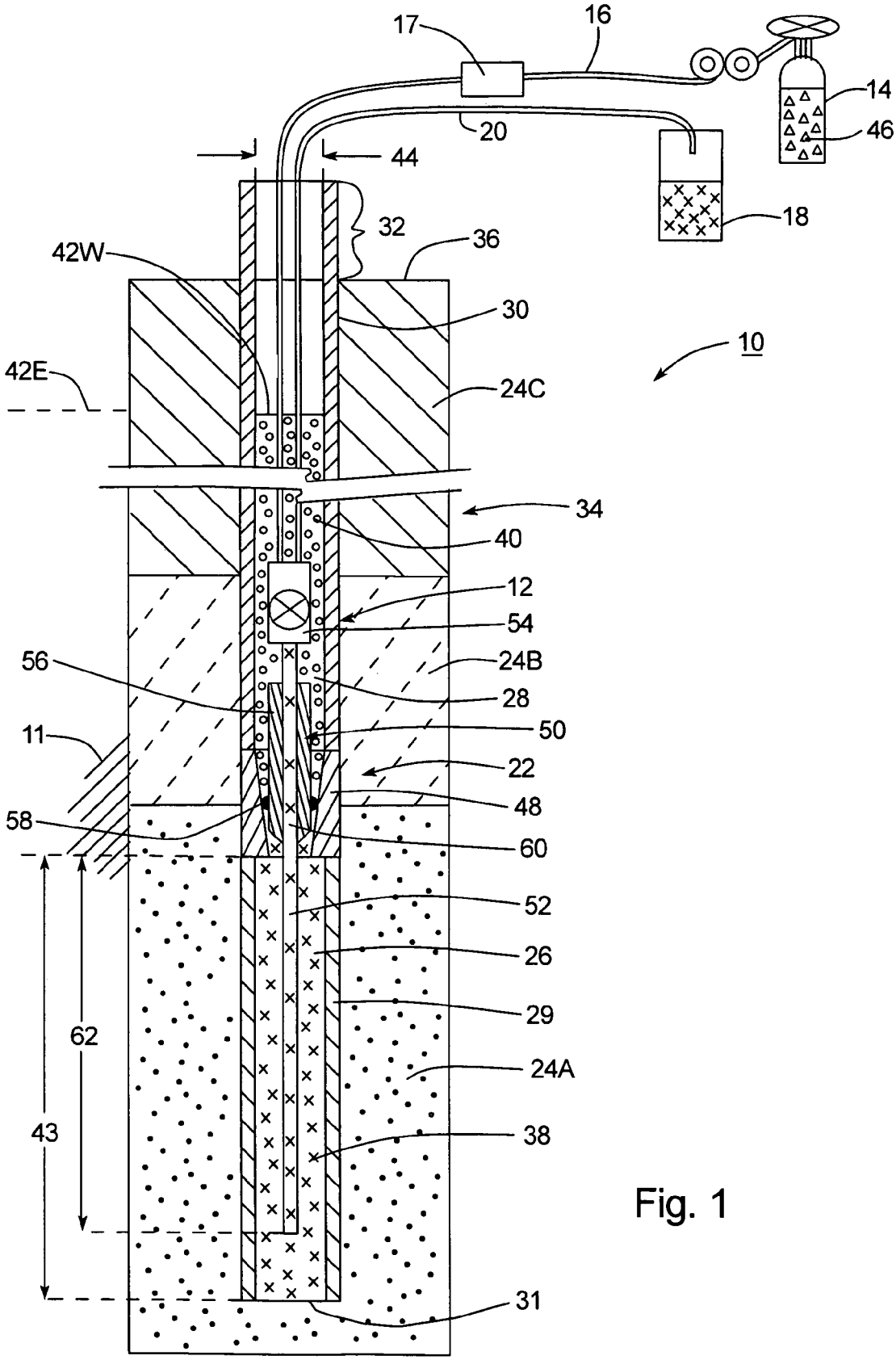
FIG. 1 is a cross-sectional view of one embodiment of a fluid monitoring system having features of the present invention, including one embodiment of a zone isolation assembly.

FIG. 1 is a schematic view of one embodiment of a fluid monitoring system 10 for monitoring one or more parameters of subsurface fluid from an adjacent environment 11. As used herein, the term "environment" can include naturally occurring or artificial (manmade) environments 11 of either solid or liquid materials. As non-exclusive examples, the environment 11 can include a ground formation of soil, rock or any other types of solid formations, or the environment 11 can include a portion of a body of water (ocean, lake, river, etc.) or other liquid regions.

Monitoring the fluid in accordance with the present invention can be performed in situ or following removal of the fluid from its native or manmade environment 11. As used herein, the term "monitoring" can include a one-time measurement of a single parameter of the fluid, multiple or ongoing measurements of a single parameter of the fluid, a one-time measurement of multiple parameters of the fluid, or multiple or ongoing measurements of multiple parameters of the fluid. Further, it is recognized that subsurface fluid can be in the form of a liquid and/or a gas. In addition, the Figures provided herein are not to scale given the extreme heights of the fluid monitoring systems relative to their widths.

The fluid monitoring system 10 illustrated in FIG. 1 can include a subsurface well 12, a gas source 14, a gas inlet line 16, a controller 17, a fluid receiver 18, a fluid outlet line 20 and a zone isolation assembly 22. In this embodiment, the subsurface well 12 (also sometimes referred to herein simply as "well") includes one or more layers of annular materials 24A, 24B, 24C, a first zone 26, a second zone 28, a fluid inlet structure 29, and a riser pipe 30. It is understood that although the fluid monitoring systems 10 described herein are particularly suited to be installed in the ground, various embodiments of the fluid monitoring systems 10 are equally suitable for installation and use in a body of water, or in a combination of both ground and water, and that no limitations are intended in any manner in this regard.

The subsurface well 12 can be installed using any one of a number of methods known to those skilled in the art. In non-exclusive, alternative examples, the well 12 can be installed with hollow stem auger, sonic, air rotary casing hammer, dual wall percussion, dual tube, rotary drilling, vibratory direct push, cone penetrometer methods, or any other suitable method known to those skilled in the art of drilling and/or well placement. The wells 12 described herein include a surface region 32 and a subsurface region 34. The surface region 32 is an area that includes the top of the well 12 which extends to a surface 36. Stated another way, the surface region 32 includes the portion of the well 12 that extends between the surface 36 and the top of the riser pipe 30, whether the top of the riser pipe 30 is positioned above or below the surface 36. The surface 36 can either be a ground surface or the surface of a body of water or other liquid, as non-exclusive examples. The subsurface region 34 is the portion of the well 12 that is below the surface region 32, e.g., at a greater depth than the surface region 34.

The annular materials 24A-C can include a first layer 24A (illustrated by dots) that is positioned at or near the first zone 26, and a second layer 24B (illustrated by dashes) that is positioned at or near the second zone 28. The annular materials are typically positioned in layers 24A-C during installation of the well 12. It is recognized that although three layers 24A-C are included in the embodiment illustrated in FIG. 1, greater or fewer than three layers 24A-C of annular materials can be used in a given well 12.

In one embodiment, for example, the first layer 24A can be sand or any other suitably permeable material that allows fluid to move from the surrounding ground environment 11 to the fluid inlet structure 29 of the well 12. The second layer 24B is positioned above the first layer 24A. The second layer 24B can be formed from a relatively impermeable layer that inhibits migration of fluid from the environment 11 near the fluid inlet structure 29 and the first zone 26 to the riser pipe 30 and the second zone 28. For example, the second layer 24B can include a bentonite material or any other suitable material of relative impermeability. In this embodiment, the second layer 28 helps increase the likelihood that the fluid collected through the fluid inlet structure 29 of the well 12 is more representative of the fluid from the environment 11 adjacent to the fluid inlet structure 29. The third layer 24C is positioned above the second layer 24B and can be formed from any suitable material, such as backfilled native soil, as one non-exclusive example. The third layer 24C is positioned away from the first layer 24A to the extent that the likelihood of fluid migrating from the environment 11 near the third layer 24C down to the fluid inlet structure 29 is reduced.

As used herein, the first zone 26 is a target zone from which a particular fluid sample is desired to be taken and/or monitored. Further, the second zone 28 can include fluid that is desired to be excluded from the fluid sample to be removed from the well 12 and/or tested, and is adjacent to the first zone 26. In the embodiments provided herein, the first zone 26 is positioned either directly beneath or at an angle below the second zone 28 such that the first zone 26 is further from the surface 36 of the surface region 32 than the second zone 28.

In each well 12, the first zone 26 has a first volume and the second zone 28 has a second volume. In certain embodiments, the second volume is substantially greater than the first volume because the height of the second zone 28 can be substantially greater than a height of the first zone 26. For example, the height of the first zone 26 can be on the order of between several inches to five or ten feet. In contrast, the height of the second zone 28 can be from several feet up to several hundreds or thousands of feet. Assuming somewhat similar inner dimensions of the first zone 26 and the second zone 28, the second volume can be from 100% to 100,000% greater than the first volume. As one non-exclusive example, in a 1-inch inner diameter well 12 having a depth of 1,000 feet, with the first zone 26 positioned at the bottom of the well 12, the first zone having a height of approximately five feet, the second zone 28 would have a height of approximately 995 feet. Thus, the first volume would be approximately 47 $in^3$, while the second volume would be approximately 9,378 $in^3$, or approximately 19,800% greater than the first volume.

For ease in understanding, the first zone 26 includes a first fluid 38 (illustrated with X's), and the second zone 28 includes a second fluid 40 (illustrated with O's). The first fluid 38 and the second fluid 40 migrate as a single fluid to the well 12 through the environment 11 outside of the fluid inlet structure 29. In this embodiment, a well fluid level 42W in the well 12 is the top of the second fluid 40, which, at equilibrium, is approximately equal to an environmental fluid level 42E in the environment 11, although it is acknowledged that some differences between the well fluid level 42W and the environmental fluid level 42E can occur. During equilibration of the fluid levels 42W, 42E, the fluid rises in the first zone 26 and the second zone 28 of the well 12. Due to gravitational forces and/or other influences, the fluid near an upper portion (e.g., in the second zone 28) of the well 12 will have a different composition from the fluid near a lower portion (e.g., in the first zone 26) of the well 12. Thus, although the first fluid 38 and the second fluid 40 can originate from a somewhat similar location within the environment 11, the first fluid 38 and the second fluid 40 can ultimately have different compositions at a point in time after entering the well 12, based on the relative positions of the fluids 38, 40 within the well 12.

The first fluid 38 is the liquid or gas that is desired for monitoring and/or testing. In this and other embodiments, it is desirable to inhibit mixing or otherwise commingling of the first fluid 38 and the second fluid 40 before monitoring and/or testing the first fluid 38. As described in greater detail below, the first fluid 38 and the second fluid 40 can be effectively isolated from one another utilizing the zone isolation assembly 22.

The fluid inlet structure 29 allows fluid from the first layer 24A outside the first zone 26 to migrate into the first zone 26. The design of the fluid inlet structure 29 can vary. For example, the fluid inlet structure 29 can have a substantially tubular configuration or another suitable geometry. Further, the fluid inlet structure 29 can be perforated, slotted, screened or can have some other alternative openings or pores (not shown) that allow fluid and/or various particulates to enter into the first zone 26. The fluid inlet structure 29 can include an end cap 31 at the lowermost end of the fluid inlet structure 29 that inhibits material from the first layer 24A from entering the first zone 26.

The fluid inlet structure 29 has a length 43 that can vary depending upon the design requirements of the well 12 and the subsurface monitoring system 10. For example, the length 43 of the fluid inlet structure 29 can be from a few inches to several feet or more.

The riser pipe 30 is a hollow, cylindrically-shaped structure. The riser pipe 30 can be formed from any suitable materials. In one non-exclusive embodiment, the riser pipe 30 can be formed from a polyvinylchloride (PVC) material and can be any desired thickness, such as Schedule 80, Schedule 40, etc. Alternatively, the riser pipe 30 can be formed from other plastics, fiberglass, ceramic, metal, etc. The length (oriented substantially vertically in FIG. 1) of the riser pipe 30 can vary depending upon the requirements of the system 10. For example, the length of the riser pipe 30 can be within the range of a few feet to thousands of feet, as necessary. It is recognized that although the riser pipe 30 illustrated in the Figures is illustrated substantially vertically, the riser pipe 30 and other structures of the well 12 can be positioned at any suitable angle from vertical.

The inner diameter 44 of the riser pipe 30 can vary depending upon the design requirements of the well 12 and the fluid monitoring system 10. In one embodiment, the inner diameter 44 of the riser pipe 30 is less than approximately 2.0 inches. For example, the inner diameter 44 of the riser pipe 30 can be approximately 1.85 inches. In non-exclusive alternative embodiments, the inner diameter 44 of the riser pipe 30 can be approximately 1.40 inches, 0.90 inches, 0.68 inches, or any other suitable dimension. In still other embodiments, the inner diameter 44 of the riser pipe 30 can be greater than 2.0 inches.

The gas source 14 includes a gas 46 (illustrated with small triangles) that is used to move the first fluid 38 as provided in greater detail below. The gas 46 used can vary. For example, the gas 46 can include nitrogen, oxygen, helium, air, hydrogen, or any other suitable gas. The flow of the gas 46 can be regulated by a controller (not shown), which can be manually or automatically operated and controlled, as needed.

The gas inlet line 16 is a substantially tubular line that directs the gas 46 to the well 12 or to various structures and/or locations within the well 12, as described in greater detail below.

The controller 17 can control or regulate various processes related to fluid monitoring. For example, the controller 17 can adjust and/or control timing of the gas delivery to various structures within the well 12. Additionally, or alternatively, the controller 17 can adjust and/or regulate the volume of gas 46 that is delivered to the various structures within the well 12. In one embodiment, the controller 17 can include a computerized system. It is recognized that the positioning of the controller 17 within the fluid monitoring system 10 can be varied depending upon the specific processes being controlled by the controller 17. In other words, the positioning of the controller 17 illustrated in FIG. 1 is not intended to be limiting in any manner.

The fluid receiver 18 receives the first fluid 38 from the first zone 26 of the well 12. Once received, the first fluid 38 can be monitored and/or tested by methods known by those skilled in the art. Alternatively, the first fluid 38 can be monitored and/or tested prior to being received by the fluid receiver 18. The first fluid 38 is transferred to the fluid receiver 18 via the fluid outlet line 20. Alternatively, the fluid receiver 18 can receive a different fluid from another portion of the well 12.

The zone isolation assembly 22 selectively isolates the first fluid 38 in the first zone 26 from the second fluid 40 in the second zone 28. The design of the zone isolation assembly 22 can vary to suit the design requirements of the well 12 and the fluid monitoring system 10. In the embodiment illustrated in FIG. 1, the zone isolation assembly 22 includes a docking receiver 48, a docking apparatus 50, a fluid collector 52 and a pump assembly 54.

In the embodiment illustrated in FIG. 1, the docking receiver 48 is fixedly secured to the fluid inlet structure 29 and the riser pipe 30. In various embodiments, the docking receiver 48 is positioned between and threadedly secured to the fluid inlet structure 29 and the riser pipe 30. In non-exclusive alternative embodiments, the docking receiver 48 can be secured to the fluid inlet structure 29 and/or the riser pipe 30 in other suitable ways, such as by an adhesive material, welding, fasteners, or by integrally forming or molding the docking receiver 48 with one or both of the fluid inlet structure 29 and at least a portion of the riser pipe 30. Stated another way, the docking receiver 48 can be formed unitarily with the fluid inlet structure 29 and/or at least a portion of the riser pipe 30.

In certain embodiments, the docking receiver 48 is at least partially positioned at the uppermost portion of the first zone 26. In other words, a portion of the first zone 26 is at least partially bounded by the docking receiver 48. Further, the docking receiver 48 can also be positioned at the lowermost portion of the second zone 28. In this embodiment, a portion of the second zone 28 is at least partially bounded by the docking receiver 48.

The docking apparatus 50 selectively docks with the docking receiver 48 to form a substantially fluid-tight seal between the docking apparatus 50 and the docking receiver 48. The design and configuration of the docking apparatus 50 as provided herein can be varied to suit the design requirements of the docking receiver 48. In various embodiments, the docking apparatus 50 moves from a disengaged position wherein the docking apparatus 50 is not docked with the docking receiver 48, to an engaged position wherein the docking apparatus 50 is docked with the docking receiver 48.

In the disengaged position, the first fluid 38 and the second fluid 40 are not isolated from one another. In other words, the first zone 26 and the second zone 28 are in fluid communication with one another. In the engaged position (illustrated in FIG. 1), the first fluid 38 and the second fluid 40 are isolated from one another. Stated another way, in the engaged position, the first zone 26 and the second zone 28 are not in fluid communication with one another.

The docking apparatus 50 includes a docking weight 56, a resilient seal 58 and a fluid channel 60. In various embodiments, the docking weight 56 has a specific gravity that is greater than water. In non-exclusive alternative embodiments, the docking weight 56 can be formed from materials so that the docking apparatus has an overall specific gravity that is at least approximately 1.50, 2.00, 2.50, 3.00, or 4.00. In certain embodiments, the docking weight 56 can be formed from materials such as metal, ceramic, epoxy resin, rubber, nylon, Teflon, Nitrile, Viton, glass, plastic or other suitable materials having the desired specific gravity characteristics.

In various embodiments, the resilient seal 58 is positioned around a circumference of the docking weight 56. The resilient seal 58 can be formed from any resilient material such as rubber, urethane or other plastics, certain epoxies, or any other material that can form a substantially fluid-tight seal with the docking receiver 48. In one non-exclusive embodiment, for example, the resilient seal 58 is a rubberized O-ring. In this embodiment, because the resilient seal 58 is in the form of an O-ring, a relatively small surface area of contact between the resilient seal 58 and the docking receiver 48 occurs. As a result, a higher force in pounds per square inch (psi) is achieved. For example, a fluid-tight seal between the docking receiver 48 and the resilient seal 58 can be achieved with a force that is less than approximately 1.00 psi. In non-exclusive alternative embodiments, the force can be less than approximately 0.75, 0.50, 0.40 or 0.33 psi. Alternatively, the force can be greater than 1.00 psi or less than 0.33 psi.

The fluid channel 60 can be a channel or other type of conduit for the first fluid 38 to move through the docking weight 56, in a direction from the fluid collector 52 toward the pump assembly 54. In one embodiment, the fluid channel 60 can be tubular and can have a substantially circular cross-section. Alternatively, the fluid channel 60 can have another suitable configuration. The positioning of the fluid channel 60 within the docking weight 56 can vary. In one embodiment, the fluid channel 60 can be generally centrally positioned within the docking weight 56 so that the first fluid 38 flows substantially centrally through the docking weight 56. Alternatively, the fluid channel 60 can be positioned in an off-center manner. In certain embodiments, the fluid channel 60 effectively extends from the docking weight 56 to the pump assembly 54.

The docking apparatus 50 can be lowered into the well 12 from the surface region 32. In certain embodiments, the docking apparatus 50 utilizes the force of gravity to move down the riser pipe 30, through any fluid present in the riser pipe 30 and into the engaged position with the docking receiver 48. Alternatively, the docking apparatus 50 can be forced down the riser pipe 30 and into the engaged position by another suitable means.

The docking apparatus 50 is moved from the engaged position to the disengaged position by exerting a force on the docking apparatus 50 against the force of gravity, such as by pulling in a substantially upward manner, e.g., in a direction from the docking receiver 48 toward the surface region 32, on a tether or other suitable line coupled to the docking apparatus 50 to break or otherwise disrupt the seal between the resilient seal 58 and the docking receiver 48.

The fluid collector 52 collects the first fluid 38 from the first zone 26 for transport of the first fluid 38 toward the surface region 32. The design of the fluid collector 52 can vary depending upon the requirements of the subsurface monitoring system 10. In the embodiment illustrated in FIG. 1, the fluid collector 52 is secured to the docking apparatus 50 and extends in a downwardly direction into the first zone 26 when the docking apparatus is in the engaged position. In the embodiment illustrated in FIG. 1, the fluid collector 52 is a perforated sipping tube that receives the first fluid 38 from the first zone 26. As provided previously, when the docking apparatus 50 is in the engaged position with the docking receiver 48, the first zone 26 is isolated from the second zone 28. Thus, because the fluid collector 52 is positioned within the first zone 26, in the engaged position, the fluid collector 52 only collects the first fluid 38.

The fluid collector 52 has a length 62 that can be varied to suit the design requirements of the first zone 26 and the fluid monitoring system 10. In certain embodiments, the fluid collector 52 extends substantially the entire length 43 of the fluid inlet structure 29. Alternatively, the length 62 of the fluid collector 52 can be any suitable percentage of the length 43 of the fluid inlet structure 29.

The pump assembly 54 pumps the first fluid 38 that enters the pump assembly 54 to the fluid receiver 18 via the fluid outlet line 20. The design and positioning of the pump assembly 54 can vary. In one embodiment, the pump assembly 54 is a highly robust, miniaturized low flow pump that can easily fit into a relatively small diameter wells 12, such as a 1-inch or ¾-inch riser pipe 30, although the pump assembly 54 is also adaptable to be used in larger diameter wells 12.

In the embodiment illustrated in FIG. 1, the pump assembly 54 can include one or more one-way valves (not shown in FIG. 1) such as those found in a single valve parallel gas displacement pump, double valve pump, bladder pump, electric submersible pump and/or other suitable pumps, that are utilized during pumping of the first fluid 38 to the fluid receiver 18. The one way valve(s) allow the first fluid 38 to move from the first zone 26 toward the fluid outlet line 20, without the first fluid 38 moving in the opposite direction. These types of one-way valves can include poppet valves, reed valves, electronic valves, electromagnetic valves and/or check valves, for example. The gas inlet line 16 extends to the pump assembly 54, and the fluid outlet line 20 extends from the pump assembly 54. In this embodiment, because the environmental fluid level 42E is above the level of the fluid collector 52, the level of the first fluid 38 equilibrates at a somewhat similar level within the fluid outlet line 20 (as well as the gas inlet line 16) as the environmental fluid level 42E, until such time as the first fluid 38 is pumped or otherwise transported toward the surface region 32.

As explained in greater detail below, gas 46 from the gas source 14 is delivered down the gas inlet line 16 to the pump assembly 54 to force the first fluid 38 that has migrated to the pump assembly 54 during equilibration upward through the fluid outlet line 20 to the fluid receiver 18. With this design, the gas 46 does not cause any pressurization of the riser pipe 30, nor does the gas 46 utilize the riser pipe 30 during the pumping process. Stated another way, in this and other embodiments, the riser pipe 30 does not form any portion of the pump assembly 54. With this design, the need for high-pressure riser pipe 30 is reduced or eliminated. Further, gas consumption is greatly reduced because the riser pipe 30, which has a relatively large volume, need not be pressurized.

The pump assembly 54 can be coupled to the docking apparatus 50 so that removal of the docking apparatus 50 from the well 12 likewise results in simultaneous removal of the pump assembly 54 (and the fluid collector 52) from the well 12.

In an alternative embodiment, the pump assembly 54 can be incorporated as part of the docking apparatus 50 within a single structure. In this embodiment, the docking apparatus 50 can house the pump assembly 54, thereby obviating the need for two separate structures (docking apparatus 50 and pump assembly 54) that are illustrated in FIG. 1. Instead, in this embodiment, only one structure would be used which would serve the purposes described herein for the docking apparatus 50 and the pump assembly 54. In one embodiment, the pump assembly 54 can have both the shape and the weight of the docking apparatus 50 so that the pump assembly 54 can be positioned in the engaged position relative to the docking receiver 48.

In operation, following installation of the well 12, fluid from the environment enters the first zone 26 through the fluid inlet structure 29. Before the docking apparatus 50 is in the engaged position, the first zone 26 and the second zone 28 are in fluid communication with one another, thereby allowing the fluid to flow upwards and mix into the second zone while the fluid level is equilibrating within the well 12.

During a monitoring, sampling or testing process, the docking apparatus 50 is lowered into the well 12 down the riser pipe 30 until the docking apparatus 50 engages with the docking receiver 48. The resilient seal 58 forms a fluid-tight seal with the docking receiver 48 so that the first zone 26 and the second zone 28 are no longer in fluid communication with one another. At this point the fluid within the well becomes separated into the first fluid 38 and the second fluid 40.

In the embodiment illustrated in FIG. 1, the fluid collector 52 begins collecting the first fluid 38, resulting in a raising of the first fluid 38 upwards from the fluid collector 52 toward the pump assembly 54, depending upon the environmental fluid level 42E. The first fluid 38 remains isolated from the second fluid 40 during this process since the pump assembly 54 is self-contained and does not rely on the riser pipe 30 as part of the structure of the pump assembly 54 in any way.

The controller 17 (or an operator of the system) can commence the flow of gas 46 to the pump assembly 54 to begin pumping the first fluid 38 through the fluid outlet line 20 to the fluid receiver 18, as described in greater detail below. Once the first fluid 38 has been substantially purged from the first zone 26, the controller 17 can stop the flow of gas 46, which effectively stops the pumping process. The first zone 26 can then refill with more fluid from the environment 11, which can then be monitored, analyzed and/or removed for further testing as needed. Alternatively, the process of purging the fluid can be immediately followed by sampling the fluid 38, with the controller 17 being in continuous operation.

Because the volume of the first zone 26 is relatively small in comparison with the volume of the second zone 28, purging of the first fluid 38 from the first zone 26 occurs relatively rapidly. Further, because the first zone 26 is the sampling zone from which the first fluid 38 is collected, there is no need to purge or otherwise remove any of the second fluid 40 from the second zone 28. As long as the docking apparatus 50 remains in the engaged position, any fluid entering the first zone 26 will not be substantially influenced by or diluted with the second fluid 40.

Figure 2:
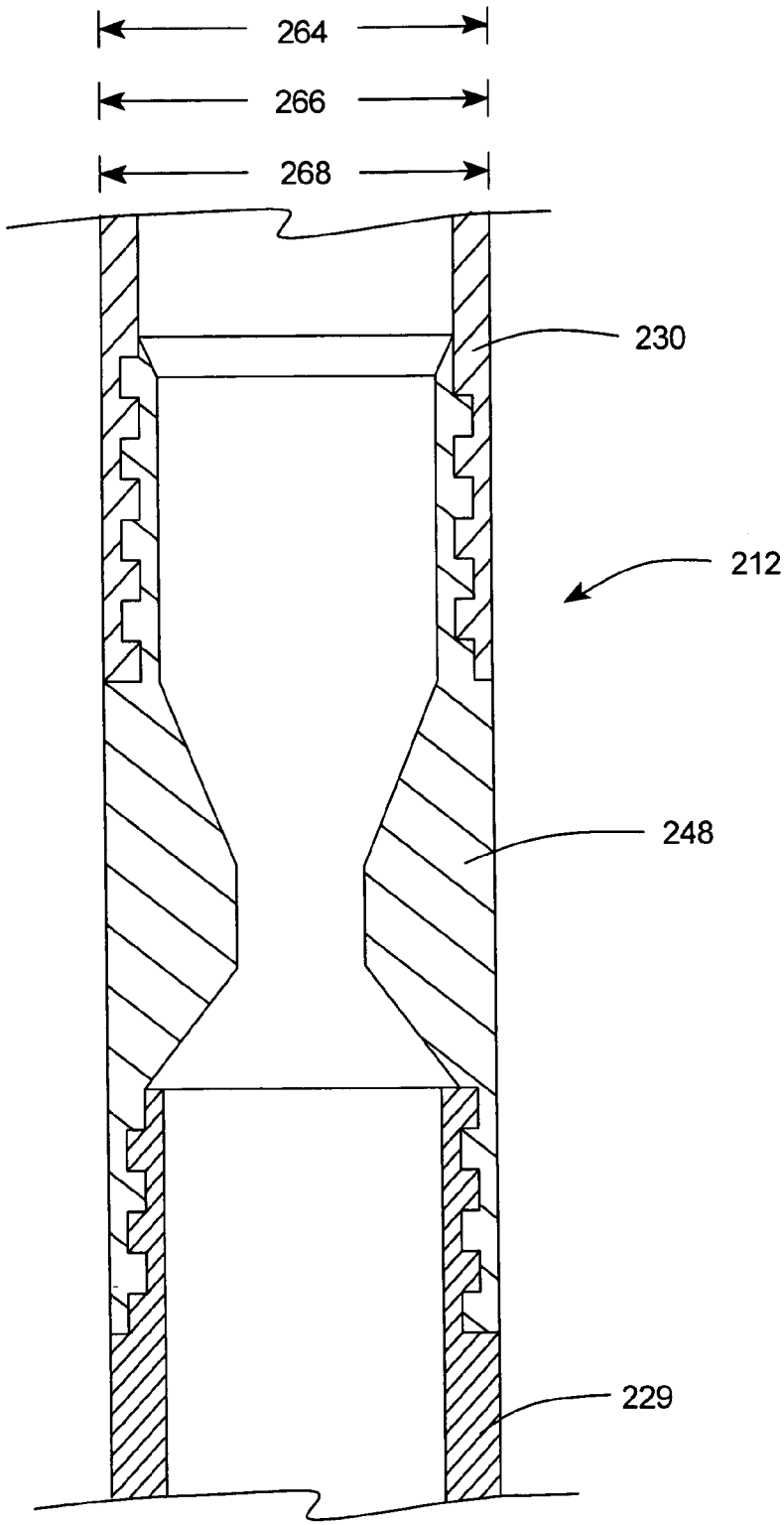
FIG. 2 is a cross-sectional view of a portion of one embodiment of a portion of the subsurface well, including a portion of a fluid inlet structure, a portion of a riser pipe and a docking receiver.

FIG. 2 is a detailed cross-sectional view of one embodiment of a portion of the subsurface well 212, including a portion of the fluid inlet structure 229, a portion of the riser pipe 230 and the docking receiver 248. In this embodiment, the docking receiver 248 is threadedly secured to the fluid inlet structure 229. Further, the riser pipe 230 is threadedly secured to the docking receiver 248. The docking receiver 248 is positioned between the fluid inlet structure 229 and the riser pipe 230. In alternative embodiments, the fluid inlet structure 229, the riser pipe 230 and/or the docking receiver 248 can be secured to one another by a different mechanism, such as by an adhesive material, welding, or any other suitable engagement means. Still alternatively, the fluid inlet structure 229, the riser pipe 230 and/or the docking receiver 248 can be formed or molded as a unitary structure, which may or may not include homogeneous materials.

The fluid inlet structure 229 has an outer diameter 264, the riser pipe 230 has an outer diameter 266, and the docking receiver 248 has an outer diameter 268. In this embodiment, the outer diameters 264, 266, 268 are substantially similar so that the outer casing of the well 212 has a standard form factor and is relatively uniform for easier installation. Alternatively, the outer diameters 264, 266, 268 can be different from one another.

Figure 3A:
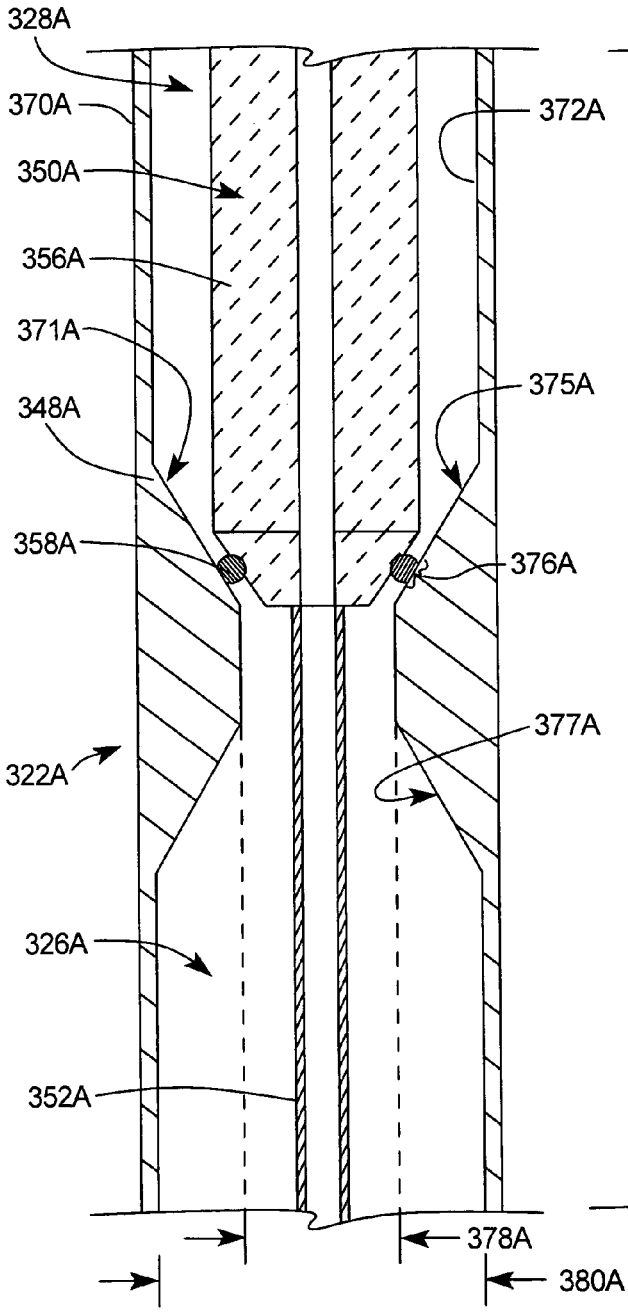
FIG. 3A is a cross-sectional view of a portion of an embodiment of the zone isolation assembly including a docking apparatus shown in an engaged position with a first embodiment of the docking receiver.

FIG. 3A is a cross-sectional view of a portion of an embodiment of the zone isolation assembly 322A including a docking apparatus 350A shown in the engaged position with a first embodiment of the docking receiver 348A. In this embodiment, the docking apparatus 350A includes the docking weight 356A and the resilient seal 358A. The force of gravity causes the docking weight 356A to impart a substantially downward force on the resilient seal 358A, which in turn, imparts a substantially downward force on the docking receiver 348A to form and maintain a seal between the docking apparatus 350A and the docking receiver 348A.

In one embodiment, the resilient seal 358A can be an O-ring. For example, the O-ring can be formed from a compressible material such as rubber, plastic, epoxy, or any other suitable material that is compatible with the docking receiver 348A for forming a fluid-tight seal to maintain fluid isolation between the first zone 326A and the second zone 328A. Alternatively, the resilient seal 358A can have another suitable configuration that is different than an O-ring.

Because of the relatively small surface area of the O-ring or other similar resilient seal 358A that is in contact with the docking receiver 348A when the docking apparatus 350A is in the engaged position, and the relatively high specific gravity of the docking weight 356A, a higher force in terms of pounds per square inch (psi) is achieved between the resilient seal 358A and the docking receiver 348A. As a result, the likelihood of achieving a fluid-tight seal is increased, and the likelihood of fluid leakage between the docking receiver 348A and the docking apparatus 350A is reduced. Additionally, because of the relatively high force between the resilient seal 358A and the docking receiver 348A, in various embodiments, the resilient seal 358A is not inflatable. In these embodiments, the force of gravity is substantial enough to maintain the required fluid-tight seal and maintain the docking apparatus 350A in the engaged position.

Further, in the embodiment illustrated in FIG. 3A, the docking receiver 348A has an exterior surface 370A and an interior surface 371A having a substantially linear upper section 372A, and roughly an hourglass-shaped lower section 374A. In one embodiment, the upper section 372A of the interior surface 371A is substantially parallel with the exterior surface 370A. With this design, the docking apparatus 350A move easily upward or downward in the upper section 372A, and can firmly seat onto the lower section 374A of the docking receiver 348A when engaging with the docking receiver 348A.

The lower section 374A has a proximal region 375A and a distal region 377A. The proximal region 375A includes a contact surface 376A. The contact surface 376A is the portion of the lower section 374A that contacts the docking apparatus 350A when the docking apparatus 350A is in the engaged position, as illustrated in FIG. 3A. In the embodiment illustrated in FIG. 3A, the contact surface 376A is substantially annular in shape. In alternative embodiments, the contact surface 376A can have another configuration. The distal region 377A is positioned more distally from the surface region 32 (illustrated in FIG. 1) than the contact surface 376A.

In certain embodiments, the lower section 374A has an inner diameter 378A near the contact surface 376A that is different than an inner diameter 380A at one or more locations of the distal region 377A of the lower section 376A (only one inner diameter 380A of many possible inner diameters is illustrated in FIG. 3A). Stated another way, the inner diameter 378A, 380A of the lower section 374A changes moving in a downwardly direction from the contact surface 376A toward the fluid inlet structure 229 (illustrated in FIG. 2). In one embodiment, the inner diameter 378A, 380A increases moving in a downwardly direction from the contact surface 376A toward the fluid inlet structure 229. With this design, the first zone 326A can hold a greater volume of the first fluid 38 (illustrated in FIG. 1) than if the inner diameter 378A, 380A remained constant moving in a downwardly direction from the contact surface 376A toward the fluid inlet structure 229. In addition, a greater spacing between the fluid collector 352A and the docking receiver 348A can be achieved.

Figure 3B:
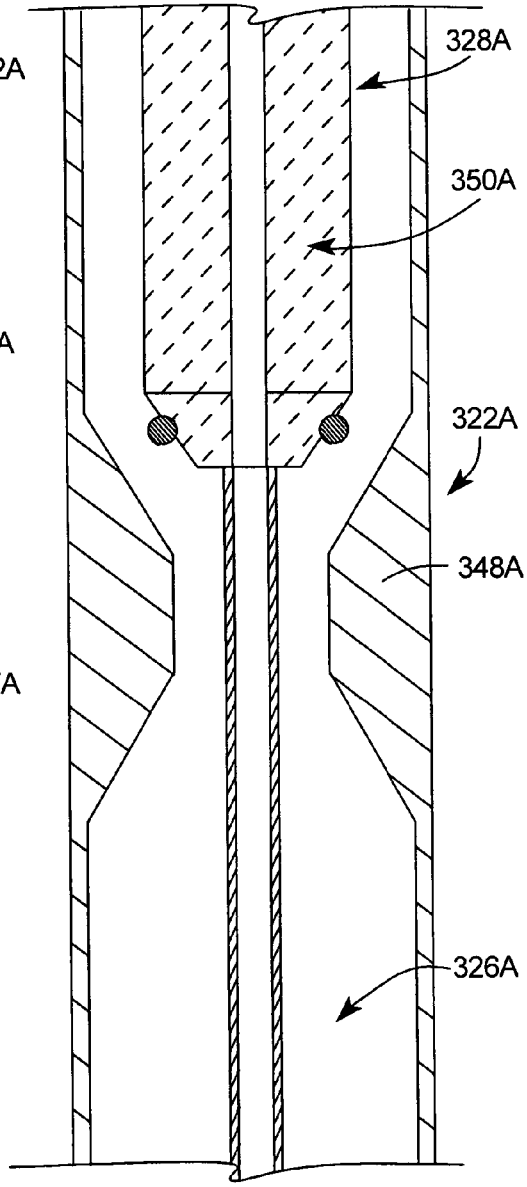
FIG. 3B is a cross-sectional view of the portion of the zone isolation assembly illustrated in FIG. 3A, shown in a disengaged position.

FIG. 3B is a cross-sectional view of the zone isolation assembly 322A illustrated in FIG. 3A, including the docking apparatus 350A shown in the disengaged position relative to the docking receiver 348A. In the disengaged position, any fluid that migrates into the first zone 326A through the fluid inlet structure 229 (illustrated in FIG. 2) is not inhibited by the docking apparatus 350A from moving into the second zone 328A to at least partially fill the riser pipe 230 (illustrated in FIG. 2). In other words, in the disengaged position, the first zone 326A and the second zone 328A are in fluid communication with one another.

Figures 3C, 3D:
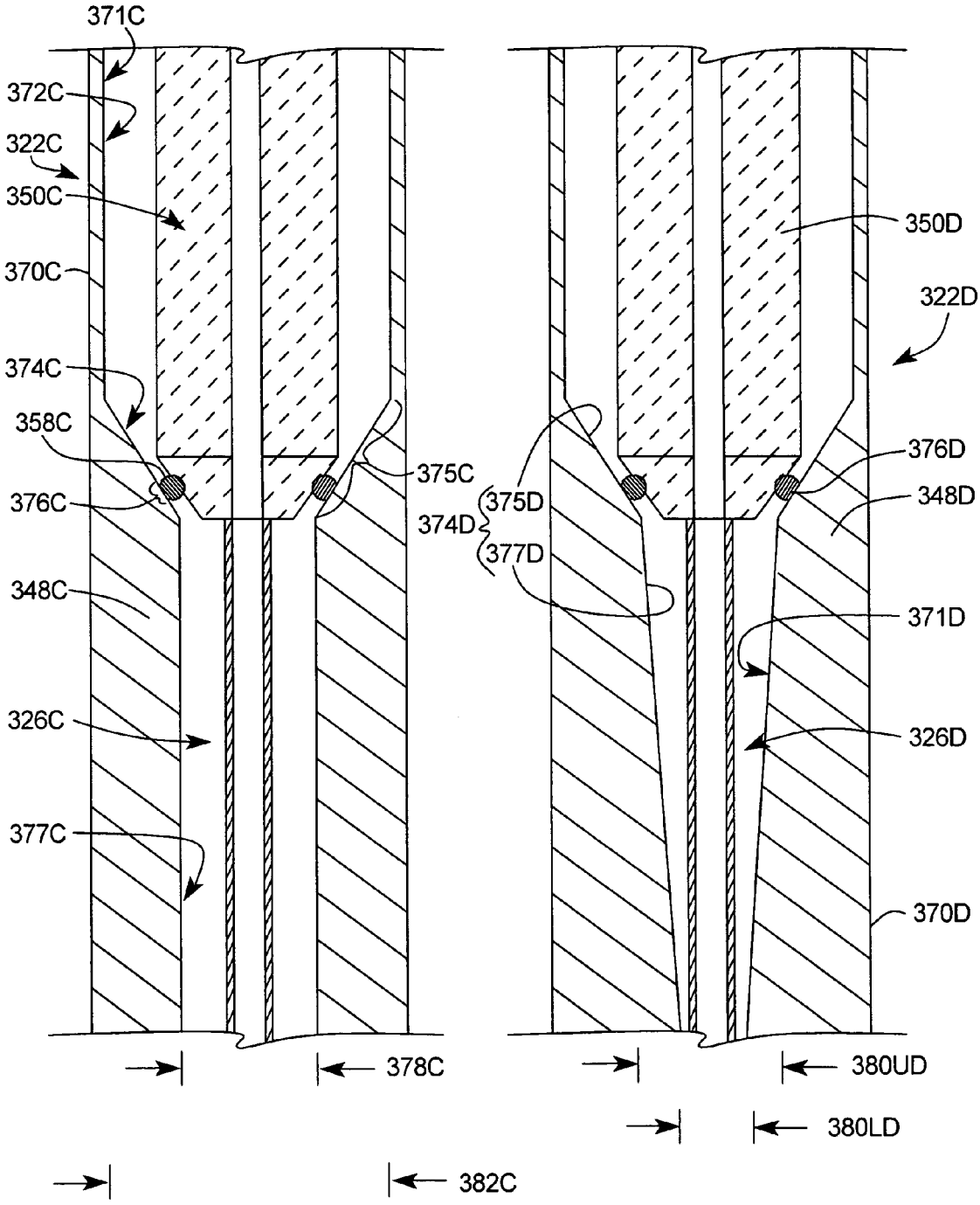
FIG. 3C is a cross-sectional view of a portion of an embodiment of the zone isolation assembly including a docking apparatus shown in an engaged position with a second embodiment of the docking receiver.
FIG. 3D is a cross-sectional view of a portion of an embodiment of the zone isolation assembly including a docking apparatus shown in an engaged position with a third embodiment of the docking receiver.

FIG. 3C is a cross-sectional view of a portion of another embodiment of the zone isolation assembly 322C including a docking apparatus 350C shown in the engaged position with a second embodiment of the docking receiver 348C. In this embodiment, the docking receiver 348C has an exterior surface 370C and an interior surface 371C having a substantially linear upper section 372C with a substantially constant inner diameter 382C, and a lower section 374C that is positioned more distally from the surface region 32 (illustrated in FIG. 1) than the upper section 372C. In one embodiment, the upper section 372C of the interior surface 371C is substantially parallel with the exterior surface 370C.

In the embodiment illustrated in FIG. 3C, the lower section 374C has a tapered proximal region 375C and a distal region 377C positioned more distally from the upper section 372C than the proximal region 375C. The proximal region 375C includes a contact surface 376C that is in contact with the docking apparatus 350C when the docking apparatus 350C is in the engaged position, as illustrated in FIG. 3C. The contact surface 376C has an inner diameter 378C that is smaller than the inner diameter 382C of the upper section 372C. In this embodiment, the distal region 377C is substantially parallel with the exterior surface 370C. Stated another way, the inner diameter 378C of the distal region 377C is substantially constant, although smaller than the inner diameter 382C of the upper section 372C. The reduced inner diameter 378C of the distal region 377C of the lower section 374C provides a smaller volume in the first zone 326C. Because the first zone 326C has a somewhat smaller volume, the volume of the first fluid to be purged from the first zone 326C is reduced, thereby decreasing the purge time prior to sampling the first zone 326C.

FIG. 3D is a cross-sectional view of a portion of another embodiment of the zone isolation assembly 322D including a docking apparatus 350D shown in the engaged position with a third embodiment of the docking receiver 348D. In this embodiment, the lower section 374D includes a proximal region 375D and a distal region 377D. The distal region 377D has an upper inner diameter 380UD that is greater than a lower inner diameter 380LD of the distal region 377D of the lower section 374D. Thus, the distal region 377D of the lower section 374D is tapered so that the inner diameter decreases in a direction from the contact surface 376D toward the fluid inlet structure 229 (illustrated in FIG. 2). In other words, the distal region 377D is non-parallel with the exterior surface 370D. With this design, the volume of the first zone 326D is further reduced. As a result of the reduced volume of the first zone 326D, the volume of groundwater to be purged from the first zone 326D is reduced even more, thereby decreasing the purge time prior to sampling the first zone 326D.

Figure 4:
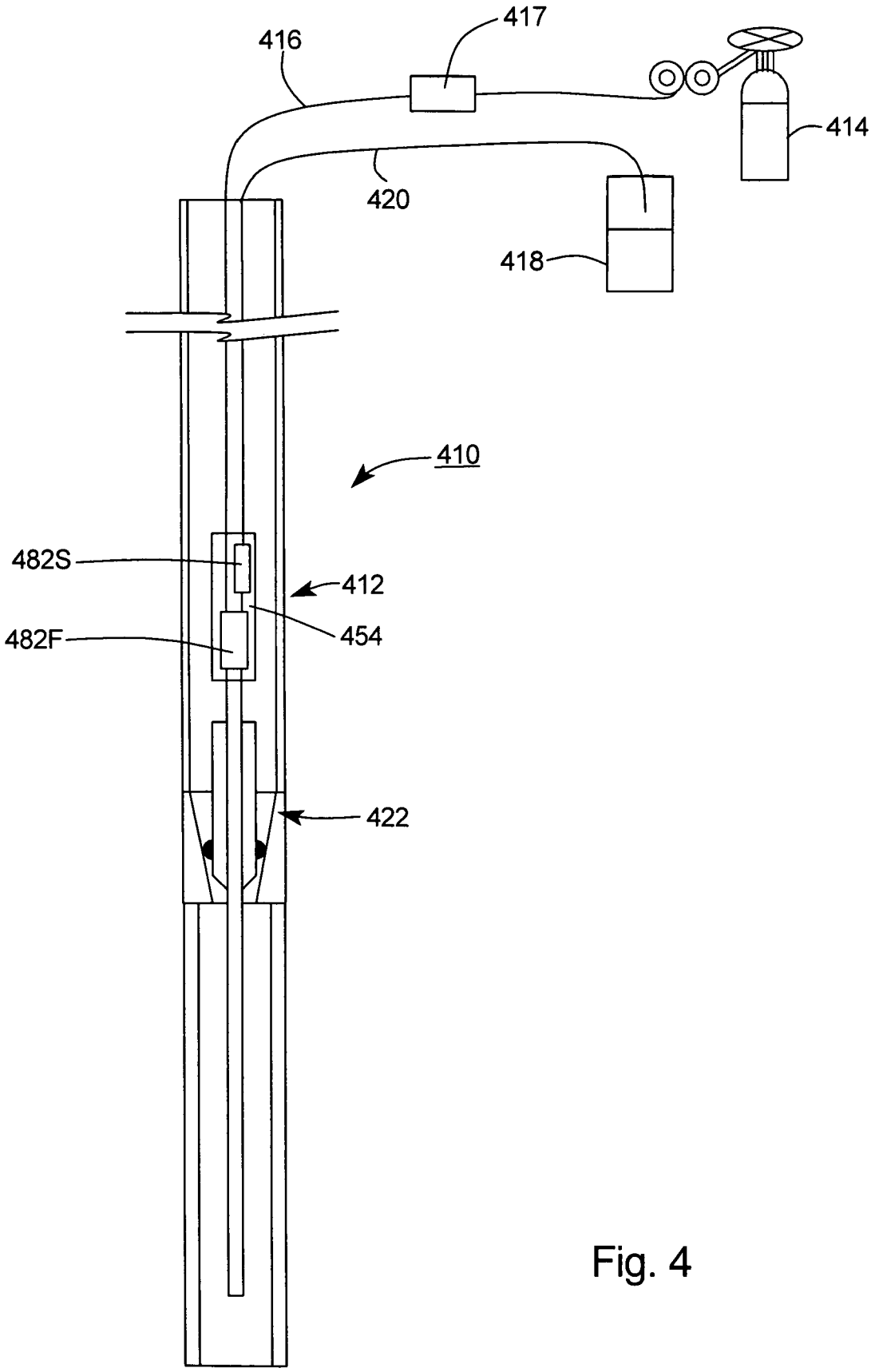
FIG. 4 is a schematic view of another embodiment of the fluid monitoring system.

FIG. 4 is a schematic view of another embodiment of the fluid monitoring system 410. In FIG. 4, the environment 11 (illustrated in FIG. 1) and the annular materials 24A-C (illustrated in FIG. 1) have been omitted for simplicity. In the embodiment illustrated in FIG. 4, the fluid monitoring system 410 includes components and structures that are somewhat similar to those previously described, including the subsurface well 412, the gas source 414, the gas inlet line 416, the controller 417, the fluid receiver 418, the fluid outlet line 420 and the zone isolation assembly 422. However, in this embodiment, the pump assembly 454 (described in greater detail below) of the zone isolation assembly 422 includes two one-way valves including a first valve 482F and a second valve 482S. The pump assembly 454 provides one or more advantages over other types of pump assemblies as set forth herein.

Figure 5:
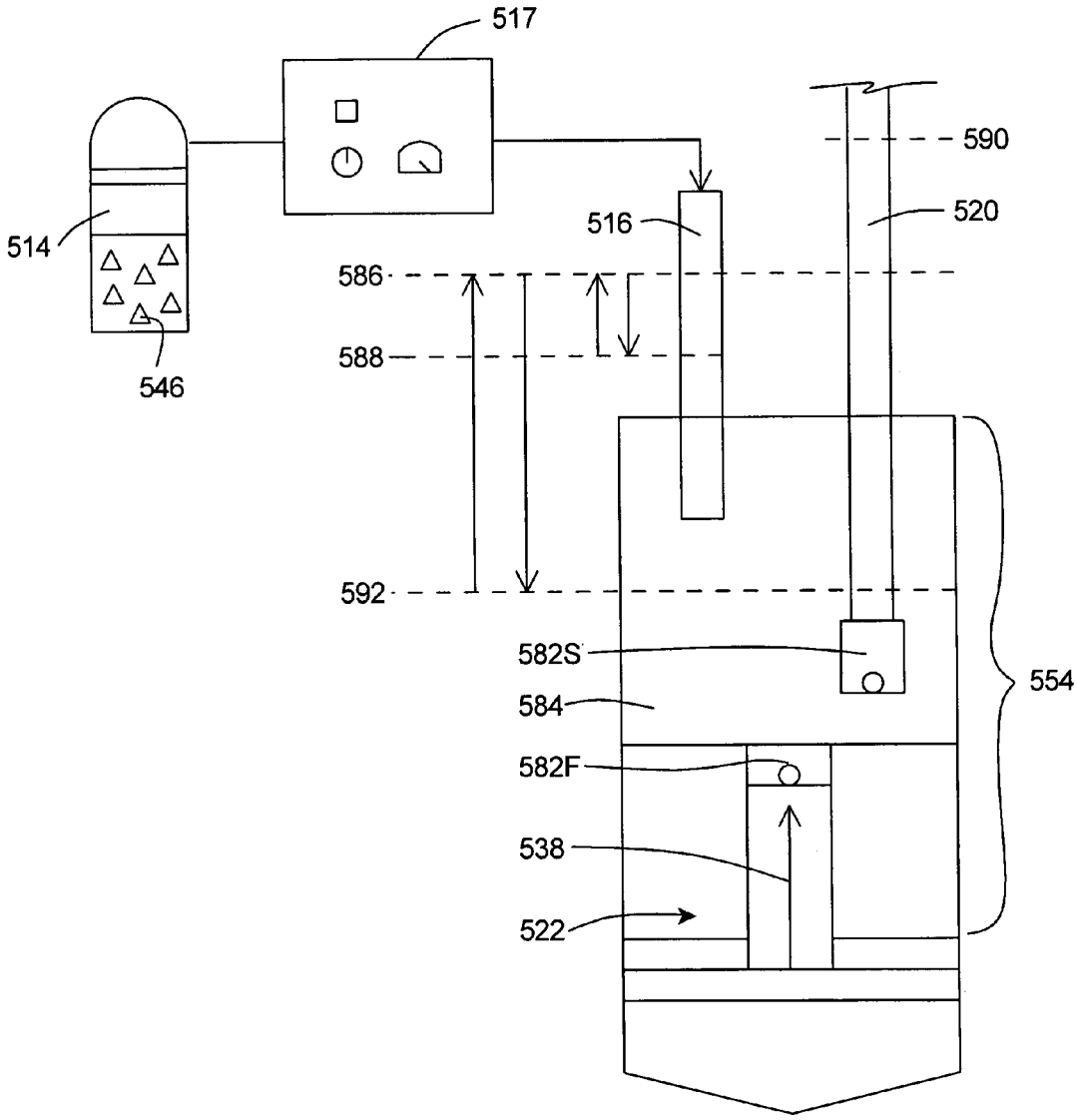
FIG. 5 is a schematic view of a portion of one embodiment of the fluid monitoring system including a pump assembly.

FIG. 5 is a schematic diagram of a portion of one embodiment of the fluid monitoring system 510 including a gas source 514, a gas inlet line 516, a controller 517, a fluid outlet line 520, a zone isolation assembly 522, and a pump assembly 554. The zone isolation assembly 522 functions in a substantially similar manner as previously described. More specifically, the first zone 26 (illustrated in FIG. 1) is isolated from the second zone 28 (illustrated in FIG. 1) so that the first fluid 538 can migrate or be drawn into the pump assembly 554.

The specific design of the pump assembly 554 can vary. In this embodiment, the pump assembly 554 is a two-valve, two-line assembly. The pump assembly 554 includes a pump chamber 584, a first valve 582F, a second valve 582S, a portion of the gas inlet line 516 and a portion of the fluid outlet line 520. The pump chamber 584 can encircle one or more of the valves 582F, 582S and/or portions of the lines 516, 520.

The first valve 582F is a one-way valve that allows the first fluid (represented by arrow 538) to migrate or otherwise be transported from the first zone 26 into the pump housing 584. For example, the first valve 582F can be a check valve or any other suitable type of one-way valve that is open as the well fluid level 42W (illustrated in FIG. 1) equilibrates with the environmental fluid level 42E (illustrated in FIG. 1). As the level of the first fluid 538 rises, the first valve 582F is open, allowing the first fluid 538 to pass through the first valve 582F and into the pump chamber 584. However, if the level of the first fluid 538 begins to recede, the first valve 582F closes and inhibits the first fluid 538 from moving back into the first zone 26.

The second valve 582S can also be a one-way valve that operates by opening to allow the first fluid 538 into the fluid outlet line 520 as the level of the first fluid 538 rises within the pump chamber 584 due to the equilibration process described previously. However, any back pressure in the fluid outlet line 520 causes the second valve 582S to close, thereby inhibiting the first fluid 538 from receding from the fluid outlet line 520 back into the pump chamber 584.

In certain embodiments, the first fluid 538 within the fluid outlet line 520 is systematically moved toward and into the fluid receiver 18 (illustrated in FIG. 1). In FIG. 5, two different embodiments for moving the first fluid 538 toward the fluid receiver 18 are illustrated. In the first embodiment, the first fluid 538 is allowed to equilibrate to an initial fluid level 586 in both the gas inlet line 516 and the fluid outlet line 520. The controller 517 (or an operator) then causes the gas 546 from the gas source 514 to move downward in the gas inlet line 516 to force the first fluid 538 to a second fluid level 588 in the gas inlet line 516. This force causes the first valve 582F to close, and because the first fluid 538 has nowhere else to move to, the first fluid 538 force the second valve 582S to open to allow the first fluid 538 to move in an upwardly direction in the fluid outlet line 520 to a third fluid level 590 in the fluid outlet line 520.

The gas source 514 is then turned off to allow the level of the first fluid 538 in the gas inlet line 516 to equilibrate with the environmental fluid level 42E. The second valve 582S closes, inhibiting any change in the level of the first fluid 538 in the fluid outlet line 520. Once the first fluid 538 in the gas inlet line 516 has equilibrated with the environmental fluid level 42E, the process of opening the gas source 514 to move the gas 546 downward in the gas inlet line 516 is repeated. Each such cycle raises the level of the first fluid 538 in the fluid outlet line 520 until a desired amount of the first fluid 538 reaches the fluid receiver 18. The gas cycling in this embodiment can be utilized regardless of the time required for the first fluid 538 to equilibrate, but this embodiment is particularly suited toward a relatively slow equilibration process.

In the second embodiment illustrated in FIG. 5, a greater volume of gas 546 is used following equilibration of the first fluid to the initial fluid level 586. Thus, in this embodiment, instead of maintaining the gas 546 within the gas inlet line 516 during each cycle, the gas source 514 is opened until the first fluid 538 is forced downward, out of the gas inlet line 516 and downward in the pump chamber 584 to a fourth fluid level 592 within the pump chamber 584. As provided previously, when the gas 546 is forced downward into the pump chamber 584, the first valve 582F closes and the second valve 582S opens. This allows the first fluid 538 to move upward in the fluid outlet line 520 to a greater extent during each cycle. The gas source 514 is then closed, the first fluid within the pump chamber 584 and the gas inlet line 516 equilibrates, and the cycle is repeated until the desired volume of first fluid 538 is delivered to the fluid receiver 18. The cycling in this embodiment can be utilized regardless of the time required for the first fluid 538 to equilibrate, but this embodiment is particularly suited toward a relatively rapid equilibration process.

With these designs, because the gas 546 is cycled up and down within the gas inlet line 516 and or pump chamber 584, and no pressurization of the riser pipe 30 (illustrated in FIG. 1) is required, only a small volume of gas 546 is consumed, and the gas 546 is thereby conserved. Further, in this embodiment, the gas 546 does not come into contact with the first fluid 538 in the fluid outlet line 520. Consequently, potential VOC loss caused by contact between the gas 546 and the first fluid 538 can be inhibited or eliminated.

Figure 6:
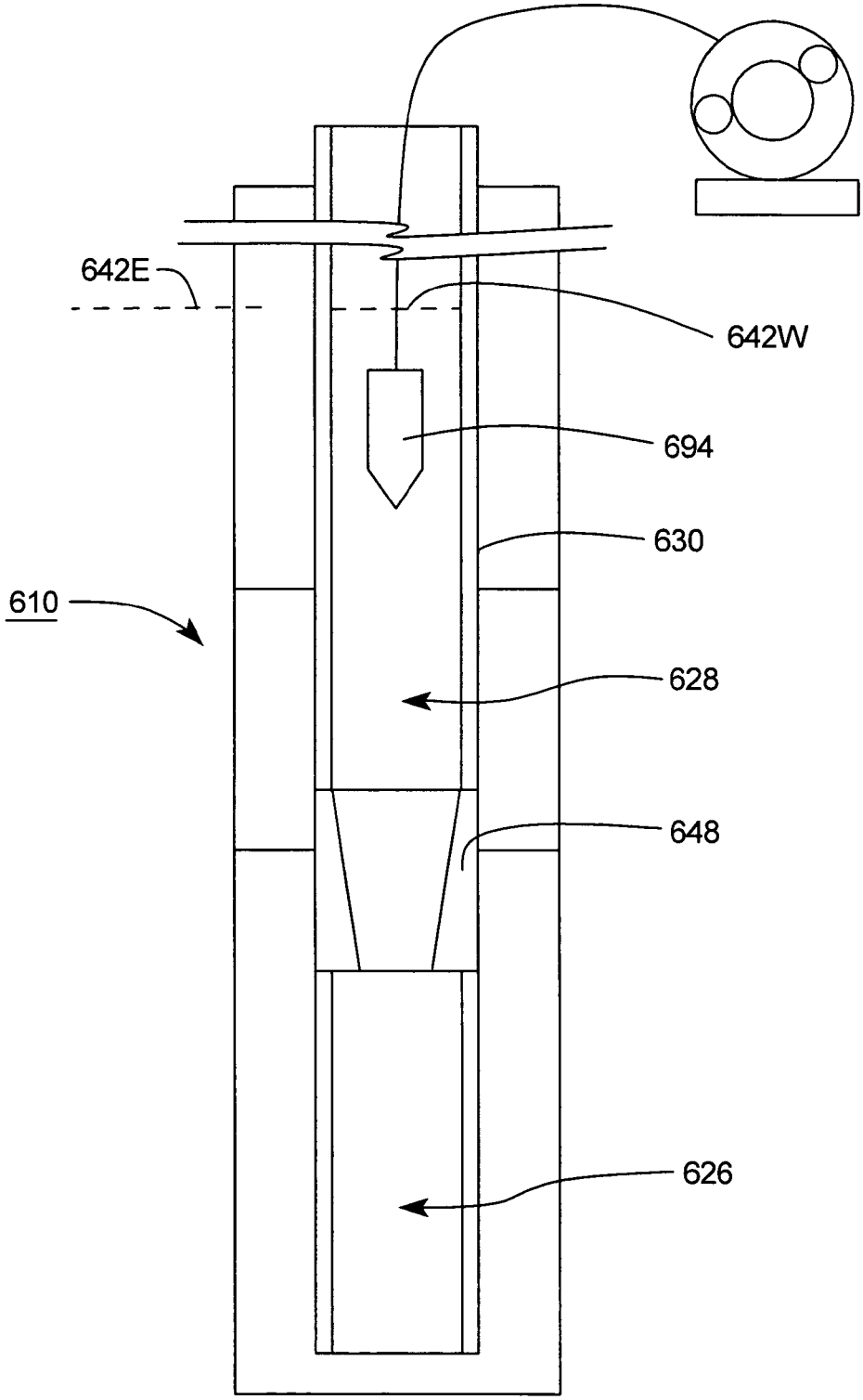
FIG. 6 is a schematic view of a portion of another embodiment of the fluid monitoring system.

FIG. 6 is a schematic view of a portion of another embodiment of the fluid monitoring system 610. In this embodiment, the docking apparatus 50 (illustrated in FIG. 1, for example) described in previous embodiments has been removed and replaced with a portable fluid level sensor 694, while the docking receiver 648 can be left in place. Thus, in this embodiment, determining the well fluid level 642W within the riser pipe 630 can easily be achieved because without the docking apparatus 50 in the engaged position, the first zone 626 and the second zone 628 are in fluid communication with one another, allowing the well fluid level 642W to equilibrate with the environmental fluid level 642E.

In an alternative embodiment, the docking apparatus 50 need not be completely removed from the riser pipe 630 to determine the well fluid level 642W. Rather, the docking apparatus 50 need only be moved upward to the disengaged position to permit the first zone 626 and the second zone 628 to be in fluid communication with one another, at which time the well fluid level 642W can be determined with the portable fluid level sensor 694.

Figure 7A:
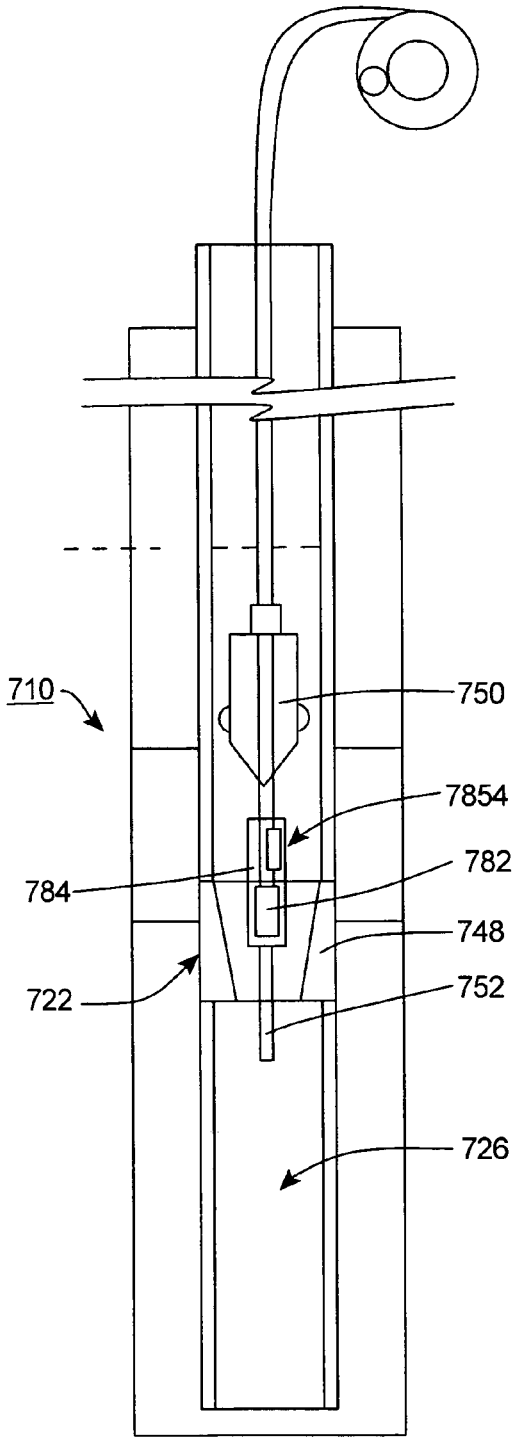
FIG. 7A is a schematic view of a portion of still another embodiment of the fluid monitoring system including the zone isolation assembly with the docking apparatus illustrated in a disengaged position.
Figure 7B:
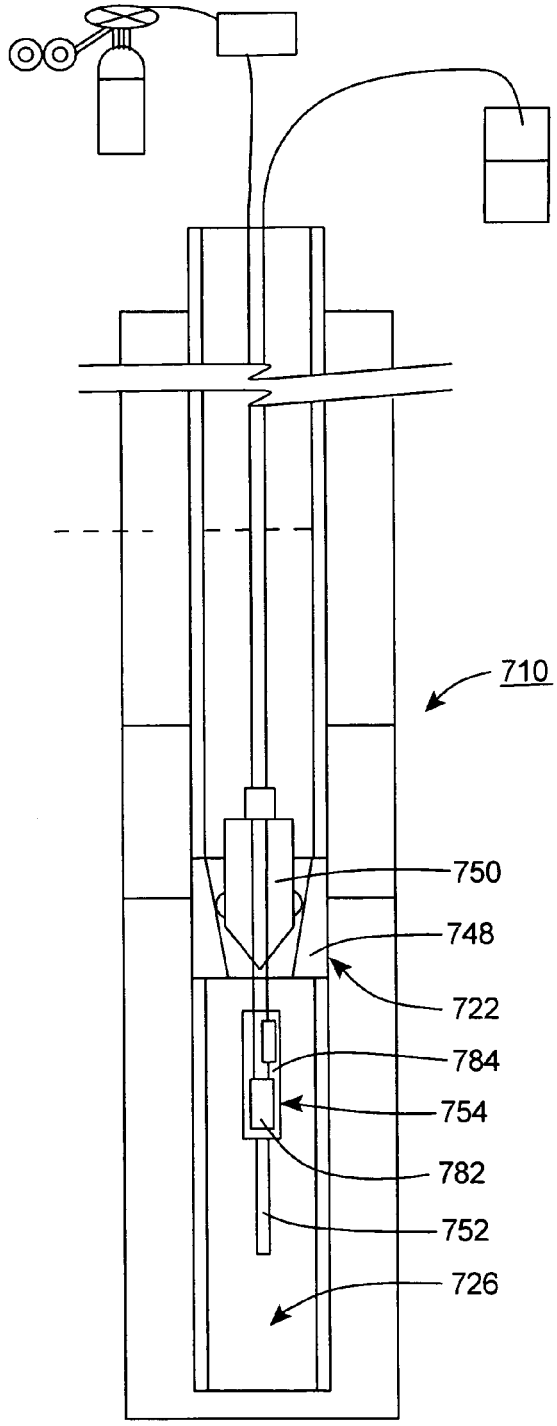
FIG. 7B is a schematic view of a portion of the fluid monitoring system illustrated in FIG. 7A, including the zone isolation assembly with the docking apparatus illustrated in an engaged position.

FIGS. 7A and 7B are schematic views of a portion of another embodiment of the fluid monitoring system 710, illustrated in the disengaged position and the engaged position, respectively. In this embodiment, the fluid monitoring system 710 includes the zone isolation assembly 722 having certain components that are somewhat similar to those previously described, such as the docking receiver 748, the docking apparatus 750, the fluid collector 752 and the pump assembly 754. The docking apparatus 750, the fluid collector 752 and the pump assembly 754 are lowered into the riser pipe 730 as illustrated in FIG. 7A.

However, in this embodiment, the pump assembly 754 is positioned beneath the docking apparatus 750 so that when the docking apparatus 750 is in the engaged position with the docking receiver 748, the pump assembly 754 is positioned within the first zone 726. In other words, the pump assembly 754 is sized and shaped to fit down through the docking receiver 748 when the docking apparatus 750 is moved between the engaged and the disengaged positions.

In certain embodiments, the fluid collector 752 can be a fluid filter positioned at or near the entrance of the pump chamber 784, e.g., near one of the valves of the pump assembly 754. The fluid filter can inhibit any sediment or other unwanted material from entering the pump chamber 784.

In alternative embodiments, the fluid collector 752 can be a sensor that can sense or otherwise determine one or more properties of the fluid within the first zone 726. Each such sensor 752 can monitor and/or measure one or more fluid properties, which can be communicated to the controller 17 (illustrated in FIG. 1) for analysis. These properties can include, without limitation, pressure, flow, refractive index, specific conductivity, temperature, oxidation reduction potential, pH, and dissolved oxygen, as non-exclusive examples. In one non-exclusive embodiment, the sensor 752 can be a Fiber Bragg Grating (FBG) sensor.

Further, in certain embodiments that utilize the pump assembly 754 positioned within the first zone 726 when the docking apparatus 750 is in the engaged position with the docking receiver 748, the fluid collector 752 may or may not be present. In such embodiments that do not utilize the fluid collector 752, the pump assembly 754 can include a one-way valve 782 that allows the first fluid 738 to enter the pump chamber 784 directly. In these embodiments, the pump assembly 754 can include one or more one-way valves 782, as previously described herein. Moreover, in certain embodiments that utilize the fluid collector 752 positioned within the first zone 726 when the docking apparatus 750 is in the engaged position with the docking receiver 748, the pump assembly 754 may or may not be present.

Figure 8:
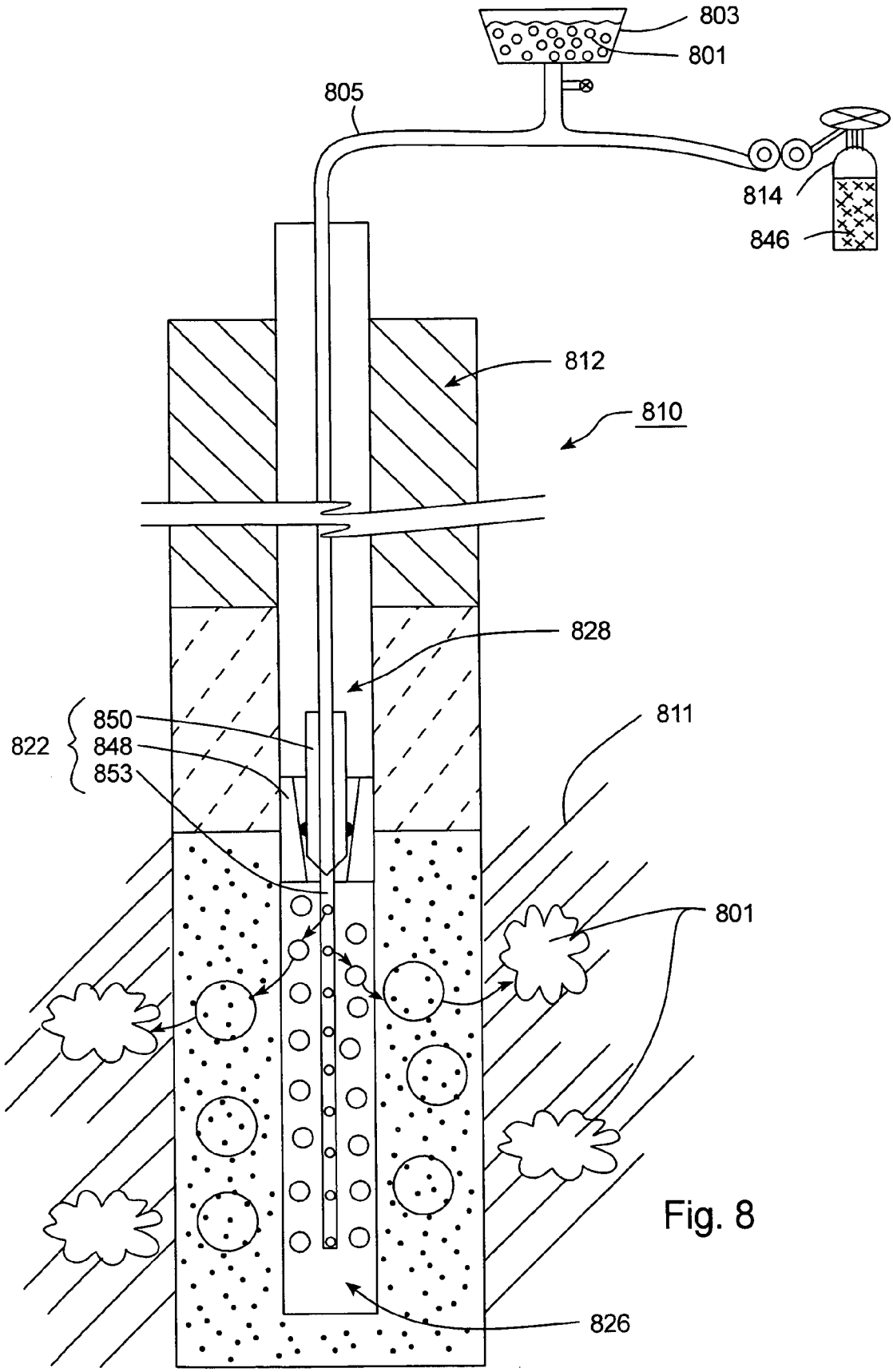
FIG. 8 is a schematic view of a portion of yet another embodiment of the fluid monitoring system.

FIG. 8 is a schematic view of a portion of yet another embodiment of the fluid monitoring system 810 including the zone isolation assembly 822. In one embodiment, the zone isolation assembly 822 includes the docking receiver 848, the docking apparatus 850, and a fluid disperser 853. As provided herein, the fluid monitoring system 810 illustrated in FIG. 8 can be used to inject or otherwise disperse a dispersion fluid 801 into the environment 811 surrounding the well 812 for remediation purposes or any other suitable purpose. The fluid disperser 853 can be perforated or can have any other type of openings that allow the dispersion fluid 801 to move from the fluid disperser to the first zone 826.

In one embodiment, the fluid monitoring system 810 also includes a dispersion fluid retainer 803 that retains the dispersion fluid 801, a gas supply 814 that supplies a gas 846, and a fluid inlet line 805 that is coupled to the docking apparatus 850. The fluid inlet line 805 can be formed from any suitable material that is compatible with the type of dispersion fluid 801 to be used in the system 810. For example, the fluid inlet line 805 can be formed from various plastics, metal, fiberglass, ceramic, etc. The dispersion fluid retainer 803 can selectively release the dispersion fluid 801 into the fluid inlet line 805 as needed. The gas supply 814 can be opened to forcibly move the gas 846 through the fluid inlet line 805, which in turn forces the dispersion fluid 801 downward and through the docking apparatus 850 into the first zone 826 via the fluid disperser 853 while the docking apparatus 850 is in the engaged position. In the engaged position, the zone isolation assembly 822 isolates the dispersion fluid 801 within the first zone 826, while inhibiting the dispersion fluid 801 from moving into the second zone 828.

In this embodiment, the type of dispersion fluid 801 used can vary depending upon the type of remediation that is necessary in the environment 811. The dispersion fluid 801 can include air, oxidizers, reducers, various bacteria, potassium permanganate, or any other suitable chemicals, either in liquid or gas form. The fluid monitoring system 810 illustrated in FIG. 8 can be used in a well 812 that contains liquid, gas, or both liquid and gas.

In an alternative embodiment (not shown), the perforated fluid disperser 853 can be omitted, and the dispersion fluid 801 can enter the first zone 826 immediately after passing through the docking apparatus 850 via the fluid inlet line 805.

Figure 9:
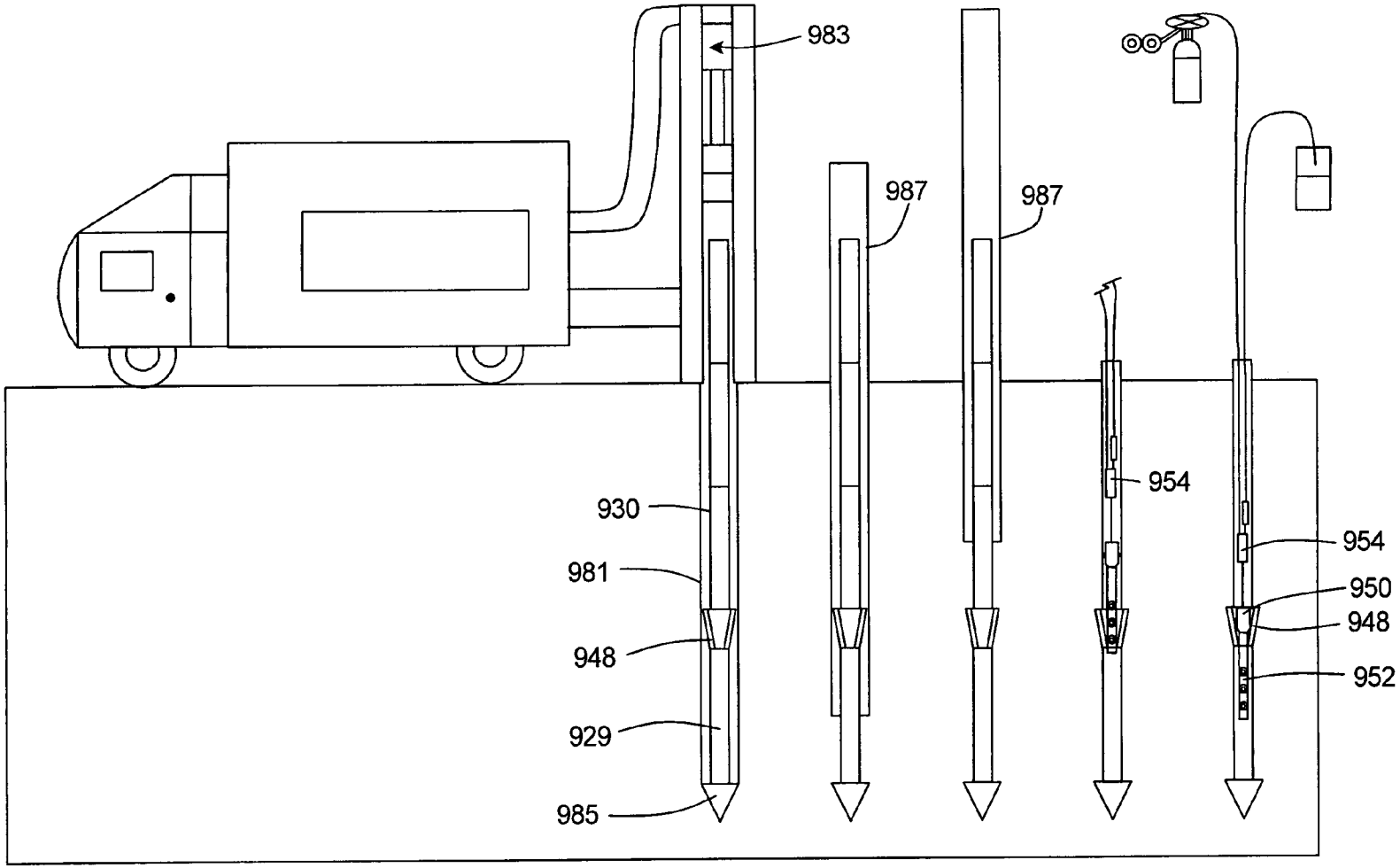
FIG. 9 is a schematic illustration of a process for installation of one embodiment the fluid monitoring system.

As indicated previously, the fluid monitoring systems provided herein can be installed by a variety of different methods. FIG. 9 illustrates one embodiment of a process for installation of the fluid monitoring system into the ground. In the embodiment illustrated in FIG. 9, a drive casing 981 can incrementally be advanced in sections (not shown) equal to the length of each drive casing length (i.e. 5-foot or 10-foot sections). In one embodiment, a bottom section of the drive casing 981 including a drive cone 985 can be loaded with the fluid inlet structure 929, the docking receiver 948 and a section of riser pipe 930 that is somewhat shorter than the drive casing 981. Before each new drive casing length is attached, a new section of riser pipe 930 is first attached.

The new length or section of drive casing 981 is then lowered over the new section of riser pipe 930 and threaded to secure attachment, with the drive casing 981 rising slightly higher than the riser pipe 930. A percussion cap (not shown) can be placed over the top of the drive casing 981. A drive hammer 983 or hydraulic ram can be used to vertically advance the drive casing 981, with the riser pipe 930 passively advancing along with the drive casing 981.

When total depth is reached, the drive casing 981 is retracted (retraction indicated by two steps 987). With the drive cone 985 attached to the bottom of the fluid inlet structure 929, the drive cone 985 remains at the bottom of the borehole while the drive casing 981 is retracted. After the drive casing 981 is fully removed from the borehole, the top section of riser pipe 930 can remain for above-ground completions, or can be removed for flush mounted surface completions. The docking apparatus 950, the fluid collector 952 and/or a pump assembly 954 can be inserted inside the direct push well 912 for collecting the first fluid 38 (illustrated in FIG. 1) as described herein.

It is recognized that the various embodiments illustrated and described herein are representative of various combinations of features that can be included in the fluid monitoring system 10 and the zone isolation assemblies 22. However, numerous other embodiments have not been illustrated and described as it would be impractical to provide all such possible embodiments herein. It is to be understood that an embodiment of the zone isolation assembly 22 can include any of the docking receivers 48, docking apparatuses 50, fluid collectors 52, pump assemblies 54, and any of the other structures described herein depending upon the design requirements of the fluid monitoring system 10 and/or the subsurface well 12, and that no limitations are intended by not specifically illustrating and describing any particular embodiment.

While the particular fluid monitoring systems 10, zone isolation assemblies 22 and docking receivers 48 as herein shown and disclosed in detail are fully capable of obtaining the objects and providing the advantages herein before stated, it is to be understood that they are merely illustrative of various embodiments of the invention. No limitations are intended to the details of construction or design herein shown other than as described in the appended claims.

What is claimed is:

1. A docking receiver for a subsurface well that extends downward from a surface region, the subsurface well including (i) a fluid inlet structure that receives a first fluid and at least partially defines a first zone, (ii) a riser pipe that at least partially defines a spaced-apart second zone that is positioned more proximally to the surface region than the first zone, (iii) a docking apparatus that selectively moves from the surface region toward the fluid inlet structure, and (iv) a fluid collector that is coupled to the docking apparatus, the docking receiver comprising:

a lower section that is secured to the fluid inlet structure, the lower section receiving the docking apparatus into an engaged position that inhibits fluid communication between the first zone and the second zone, wherein the docking receiver receives the fluid collector into the first zone when the docking apparatus is in the engaged position with the docking receiver.

2. The docking receiver of claim 1 wherein an inner diameter of the distal region decreases in a direction from the contact surface toward the fluid inlet structure.

3. The docking receiver of claim 1 wherein an inner diameter of the distal region increases in a direction from the contact surface toward the fluid inlet structure.

4. The docking receiver of claim 1 wherein the lower section has roughly an hourglass configuration.

5. The docking receiver of claim 1 further comprising an upper section that includes threads that threadedly engage the riser pipe.

6. The docking receiver of claim 1 wherein the lower section includes threads that threadedly engage the fluid inlet structure.

7. The docking receiver of claim 1 further comprising an upper section that at least partially defines the second zone.

8. The docking receiver of claim 1 wherein the lower section at least partially defines the first zone.

9. The docking receiver of claim 8 wherein the lower section at least partially defines the second zone.

10. The docking receiver of claim 1 wherein when the docking apparatus is not in the engaged position with the docking receiver, the first zone is in fluid communication with the second zone.

11. The docking receiver of claim 1 wherein the subsurface well includes a pump assembly that is coupled to the docking apparatus, and wherein the docking receiver receives the pump assembly into the first zone when the docking apparatus is in the engaged position with the docking receiver.

12. The docking receiver of claim 1 wherein in the engaged position, the docking receiver is adapted to maintain a seal with the docking apparatus substantially by the force of gravity imparted upon the docking apparatus against the docking receiver.

13. The docking receiver of claim 1 wherein the docking apparatus includes a rubberized O-ring, and in the engaged position, the contact surface is adapted to form a seal with the rubberized O-ring so that the first zone is not in fluid communication with the second zone.

14. The docking receiver of claim 1 wherein the contact surface has a tapered configuration.

15. A subsurface well including a riser pipe, a fluid inlet structure and the docking receiver of claim 1 that is secured to the riser pipe and the fluid inlet structure.

16. A docking receiver for a subsurface well that extends downward from a surface region, the subsurface well including (i) a fluid inlet structure that receives a first fluid and at least partially defines a first zone, (ii) a riser pipe that at least partially defines a spaced-apart second zone that is positioned more proximally to the surface region than the first zone, (iii) a docking apparatus that selectively moves from the surface region toward the fluid inlet structure, and (iv) a fluid collector that is coupled to the docking apparatus, the docking receiver comprising:

an upper section that is secured to the riser pipe, the upper section having an upper inner diameter that is substantially constant; and a lower section that receives the docking apparatus into an engaged position that inhibits fluid communication between the first zone and the second zone, the lower section including threads for threadedly securing the docking receiver to the fluid inlet structure, wherein the docking receiver receives the fluid collector into the first zone when the docking apparatus is in the engaged position with the docking receiver.

17. The docking receiver of claim 16 wherein the threads are external threads.

18. The docking receiver of claim 16 wherein the lower section includes a contact surface that contacts the docking apparatus when the docking apparatus is in the engaged position and a distal region that is positioned more distally from the surface region than the contact surface, the lower section having a lower inner diameter that varies within the distal region.

19. The docking receiver of claim 18 wherein the lower inner diameter of the distal region decreases in a direction from the contact surface toward the fluid inlet structure.

20. The docking receiver of claim 18 wherein the lower inner diameter of the distal region increases in a direction from the contact surface toward the fluid inlet structure.

21. The docking receiver of claim 18 wherein the contact surface is tapered.

22. The docking receiver of claim 16 wherein the upper section at least partially defines the second zone.

23. The docking receiver of claim 16 wherein the lower section at least partially defines the first zone and the second zone.

24. The docking receiver of claim 16 wherein when the docking apparatus is not in the engaged position with the docking receiver, the first zone is in fluid communication with the second zone.

25. The docking receiver of claim 16 wherein the subsurface well includes a pump assembly that is coupled to the docking apparatus, and wherein the docking receiver receives the pump assembly into the first zone when the docking apparatus is in the engaged position with the docking receiver.

26. The docking receiver of claim 16 wherein in the engaged position, the docking receiver is adapted to maintain a seal with the docking apparatus substantially by the force of gravity imparted upon the docking apparatus against the docking receiver.

27. A subsurface well including a riser pipe, a fluid inlet structure and the docking receiver of claim 16 that is secured to the riser pipe and the fluid inlet structure.

28. A docking receiver for a subsurface well that extends downward from a surface region, the subsurface well including (i) a fluid inlet structure that receives a first fluid and at least partially defines a first zone, (ii) a riser pipe that at least partially defines a spaced-apart second zone that is positioned more proximally to the surface region than the first zone, and (iii) a docking apparatus that selectively moves from the surface region toward the fluid inlet structure, the docking receiver comprising:

an upper section that is secured to the riser pipe, the upper section having an inner diameter that is substantially constant; and a lower section that is secured to the fluid inlet structure, the lower section receiving the docking apparatus into an engaged position that inhibits fluid communication between the first zone and the second zone, the lower section including a contact surface that contacts the docking apparatus when the docking apparatus is in the engaged position and a distal region that is positioned more distally from the surface region than the contact surface, the distal region having an inner diameter that decreases in a direction from the contact surface toward the fluid inlet structure.

29. A docking receiver for a subsurface well that extends downward from a surface region, the subsurface well including (i) a fluid inlet structure that receives a first fluid and at least partially defines a first zone, (ii) a riser pipe that at least partially defines a spaced-apart second zone that is positioned more proximally to the surface region than the first zone, (iii) a docking apparatus that selectively moves from the surface region toward the fluid inlet structure, and (iv) a pump assembly that is coupled to the docking apparatus, the docking receiver comprising:

an upper section that is secured to the riser pipe, the upper section having an inner diameter that is substantially constant; and a lower section that receives the docking apparatus into an engaged position that inhibits fluid communication between the first zone and the second zone, the lower section including threads for threadedly securing the docking receiver to the fluid inlet structure, wherein the docking receiver receives the pump assembly into the first zone when the docking apparatus is in the engaged position with the docking receiver.

30. A docking receiver for a subsurface well that extends downward from a surface region, the subsurface well including (i) a fluid inlet structure that receives a first fluid and at least partially defines a first zone, (ii) a riser pipe that at least partially defines a spaced-apart second zone that is positioned more proximally to the surface region than the first zone, (iii) a docking apparatus that selectively moves from the surface region toward the fluid inlet structure, and (iv) a fluid collector that is coupled to the docking apparatus, the docking receiver comprising:

an upper section that is secured to the riser pipe, the upper section having an inner diameter that is substantially constant; and a lower section that is secured to the fluid inlet structure, the lower section receiving the docking apparatus into an engaged position that inhibits fluid communication between the first zone and the second zone, the lower section including a contact surface that contacts the docking apparatus when the docking apparatus is in the engaged position and a distal region that is positioned more distally from the surface region than the contact surface, the distal region having an inner diameter that varies, wherein the docking receiver receives the fluid collector into the first zone when the docking apparatus is in the engaged position with the docking receiver.

31. A method for installing a subsurface well, the method comprising the steps of:

securing a lower section of a docking receiver to a fluid inlet structure that at least partially defines a first zone of a well; and receiving a docking apparatus that is coupled to a fluid collector with the docking receiver so that (i) the docking apparatus is in an engaged position with the docking receiver that inhibits fluid communication between the first zone and a second zone of the well, and (ii) the fluid collector is positioned within the first zone.

32. The method of claim 31 wherein the step of securing includes varying an inner diameter of a distal region of the docking receiver so that the inner diameter varies.

* * * * *

UNITED STATES PATENT AND TRADEMARK OFFICE

CERTIFICATE OF CORRECTION

PATENT NO. : 7,556,097 B2
APPLICATION NO. : 11/651875
DATED : July 7, 2009
INVENTOR(S) : Heller et al.

It is certified that error appears in the above-identified patent and that said Letters Patent is hereby corrected as shown below:

On the Title Pg, Item (56)
1 - Please replace the citation "2,776,013 A 1/1975 Tausch"" with -- 2,776,013 A 1/1957 Tausch -- in the References Cited on the front page of the patent.

Signed and Sealed this

Eighteenth Day of August, 2009

David J. Kappos

David J. Kappos
*Director of the United States Patent and Trademark Office*